United States Patent [19]

Higashiyama et al.

[11] 4,390,746

[45] Jun. 28, 1983

[54] STEREO SIGNAL DEMODULATOR HAVING AN IMPROVED SEPARATION CHARACTERISTIC

[75] Inventors: Naotoshi Higashiyama; Kazuyuki Doi, both of Tokyo, Japan

[73] Assignee: Nippon Electric Co., Ltd., Tokyo, Japan

[21] Appl. No.: 182,646

[22] Filed: Aug. 29, 1980

[30] Foreign Application Priority Data

Aug. 31, 1979 [JP] Japan ..... 54-111335

[51] Int. Cl.[3] ..... H04H 5/00

[52] U.S. Cl. ..... 179/1 GE; 329/167

[58] Field of Search ..... 179/1 GE; 329/167, 50; 370/69.1

[56] References Cited

U.S. PATENT DOCUMENTS

| | | | |
|---|---|---|---|
| 4,074,075 | 2/1978 | Ohsawa | 179/1 GE |
| 4,140,878 | 2/1979 | Ohsawa | 179/1 GE |
| 4,167,650 | 9/1979 | Kusano | 179/1 GE |
| 4,194,161 | 3/1980 | Hershberger | 179/1 GE |

*Primary Examiner*—Douglas W. Olms

*Attorney, Agent, or Firm*—Laff, Whitesel, Conte & Saret

[57] ABSTRACT

A stereo signal demodulator includes a switching circuit for separating the stereo composite signal into left and right signal components. A composite stereo signal is attenuated in a preset quantity and superimposed upon the left and right signal components after they are separated by the switching circuit. The superimposed signals cancel the crosstalk components, not by switching the composite signal, but only by attenuating the stereo composite signal in the preset quantity. Consequently, the attenuator for reducing the stereo composite signal can be provided separately from the switching circuit for the stereo demodulation. The switching circuit can then be driven by the entire power supply voltage without any DC potential loss caused by the attenuator. Moreover, there is no DC potential loss by the attenuator, and transistors of the stereo switching circuit can operate with a power voltage margin. The distortion-free dynamic range of the output can be widened and the separation factor can be enhanced. The bias voltage of the active elements is also raised, so that the distortion factor characteristics can be improved. The composite signal attenuated in the preset quantity is superimposed upon the demodulated left and right signal components. Thus, it is possible to eliminate the distortion in the attenuated composite signal, and especially to eliminate the distortion in the demodulated output signals.

11 Claims, 3 Drawing Figures

STEREO SIGNAL DEMODULATOR HAVING AN IMPROVED SEPARATION CHARACTERISTIC

BACKGROUND OF THE INVENTION

The present invention relates to demodulators and, more particularly, to stereo signal demodulators for demodulating FM (Frequency Modulated) composite stereo signals of pilot tone systems.

An FM composite stereo signal of a pilot tone system, is generally described as a composite signal consisting of a main channel signal, a sub-channel signal, a pilot signal and a SCA (Subsidiary Communication Authorization) signal. The main channel signal is a summation signal (L+R) of left and right audio signals, and the sub-channel signal contains a component of a difference signal (L−R). The sub-channel signal is an AM (Amplitude Modulated) signal of a subcarrier signal (38 KHz) modulated by the difference signal. The pilot signal is a 19 KHz signal and is a reference signal used for the separation of the left and right audio signals. The SCA signal is used for auxiliary communication. However, this SCA signal is a signal component which is not necessary for the stereo demodulation. It is generally removed from the stereo composite signal before the composite signal is supplied to the stereo demodulator. Therefore, the term, "the stereo composite signal" means, hereinafter, the composite of main and sub-channel signals and the pilot signal.

The circuit for separately extracting the right and left signals from this composite signal are mainly two systems, one being a switching-type circuit and the other being a matrix-type circuit.

In the matrix-type circuit, after a filter separates the stereo composite signal into the main channel signal and the sub-channel signal, the sub-channel signal is demodulated by the subcarrier signal of 38 KHz to produce the difference signal (L−R). Those signals (L+R) and (L−R) are summed and subtracted to recover the signals L and R. However, the matrix-type circuit is not used so commonly because the circuit construction is complicated and the operation stability of this type is poor.

According to the switching system, on the other hand, the composite signal is switched so that it is separated into two signals L and R. Since the circuit construction of the switching system is simple and since the operations are relatively stable, the switching system has recently been used almost exclusively.

Although various types of circuits are proposed and used as a demodulator of the switching type, a demodulator using a differential amplifier, as disclosed in U.S. Pat. No. 3,617,641, is generally used because it is easily made in the form of a semiconductor integrated circuit. That is, the composite signal is fed to the common emitter junction of two transistors constituting the differential amplifier. They are separated by supplying a subcarrier frequency signal of 38 KHz to the base of one transistor. The other subcarrier frequency signal has a phase which is opposite to the above subcarrier signal and is supplied to the base of the other transistor.

In this instance, the separated left and right signals have the opposite signal components superposed thereon, more or less, as crosstalk components. A circuit for cancelling those crosstalk signal components is generally added. Thus crosstalk cancelling circuit is designed to attenuate the composite signals so that they have substantially the same signal level as the crosstalk components. The attenuated composite signals are separated into the attenuated left and right signals. The attenuated left and right signals of the separated left and right signals are added to cancel the crosstalk signal components. An example of such a crosstalk cancelling circuit is also described in the above U.S. patent as a circuit of resistors 100, 101 and 102 and transistors 60, 71 and 72.

The attenuation of the composite signal is usually performed by means of a T-type resistor circuit. However, in a stereo demodulator of the switching type, having such crosstalk cancelling circuit, both the attenuation of the composite signals and the separation of the attenuated composite signal are performed by a cascade connected circuit of the T-type resistor circuit; two differential amplifier type switches, and a load resistor. Especially, the T-type resistor circuit is inserted between the emitters of two transistors of the lower positioning different differential amplifier. As a result, the emitters of those transistors have a preset DC potential which is determined by the T-type resistor circuit. Consequently, bias potentials applied to the differential amplifiers, connected in series, have to be set to consider the DC potential, and the active elements, (such as the respective transistors) operate in a linear range. Even if the points described above are considered to set the bias potentials, together with the electric characteristics (such as the distortion factor), a the demodulator having the conventional crosstalk cancelling circuit cannot operate with good characteristics if power supply voltage drops significantly.

A description is now given of the case in which the power supply voltage is reduced or drops significantly. Since a DC voltage loss caused by the T-type resistor circuit is inevitable, the bias voltages applied to the active elements (such as transistors) are accordingly lowered. Thus, the active elements then begin operate in their non-linear regions. In the worst case, the transistors are driven into their saturated regions, and in the signal injecting operation for cancelling the crosstalk components is not accomplished. Then, the separation factor of the demodulation signals deteriorates remarkably. Even if the active elements are operated at a higher supply voltage which is free from a reduction of the separation factor, the margin of the voltage supplied to the active elements is lowered by the DC potential loss of the T-type resistor circuit so that the distorsion factor characteristics of the separated stereo signals deteriorate.

SUMMARY OF THE INVENTION

It is, therefore, a major object of the present invention to provide a stereo signal demodulator which has a demodulated output with improved separation and distortion, even when the power supply voltage is lowered.

Another object of the present invention is to provide a stereo signal demodulator which is suitable for construction on a semiconductor integrated circuit, with a minimum increase in the number of elements.

According to the present invention, a stereo signal demodulator includes: a switching circuit for separating the stero composite signal into left and right signal components. The separated signals are fed to an input terminal, and a circuit respectively superposes a stereo composite signal attenuated by a present amount upon the left and right signal components which are separated by the switching circuit.

According to the stereo signal demodulator of the present invention, the signals superposed on the separated left and right signal components to cancel the crosstalk components are not attained by switching the composite signal. The superposed signals are produced only by a preset attenuation of the stereo composite signal. Consequently, attenuator for reducing the stereo composite signal can be provided separately from the switching circuit for the stereo demodulation. The switching circuit can thus be driven by the entire power of the supply voltage without any DC potential loss caused by the attenuator. Moreover, since no DC potential loss is caused by the attenuator, the respective transistors of the stereo switching circuit can be operated with a power voltage margin, so that the distortion-free dynamic range of the output can be widened and that the separation factor can be enhanced. Still moreover, when the operations of the present invention are accomplished at the same power supply voltage as that of the prior art, the bias voltage to the active elements is also raised, so that the distortion factor characteristics can be improved. Also, since the composite signal attenuated in the preset quantity is superposed upon the demodulated left and right signal components, it is possible to eliminate the distortion in the attenuated composite signal which is caused in the prior art by the switching of the attenuated composite signal, and especially, to eliminate the distortion in the demodulated output signals due to the crosstalk cancelling operation.

BRIEF DESCRIPTION OF THE DRAWINGS

These and other objects and advantages of the present invention will become more apparent from the following description in conjunction with the accompanying drawings, in which.

DETAILED DESCRIPTION OF THE INVENTION

Figure 1:
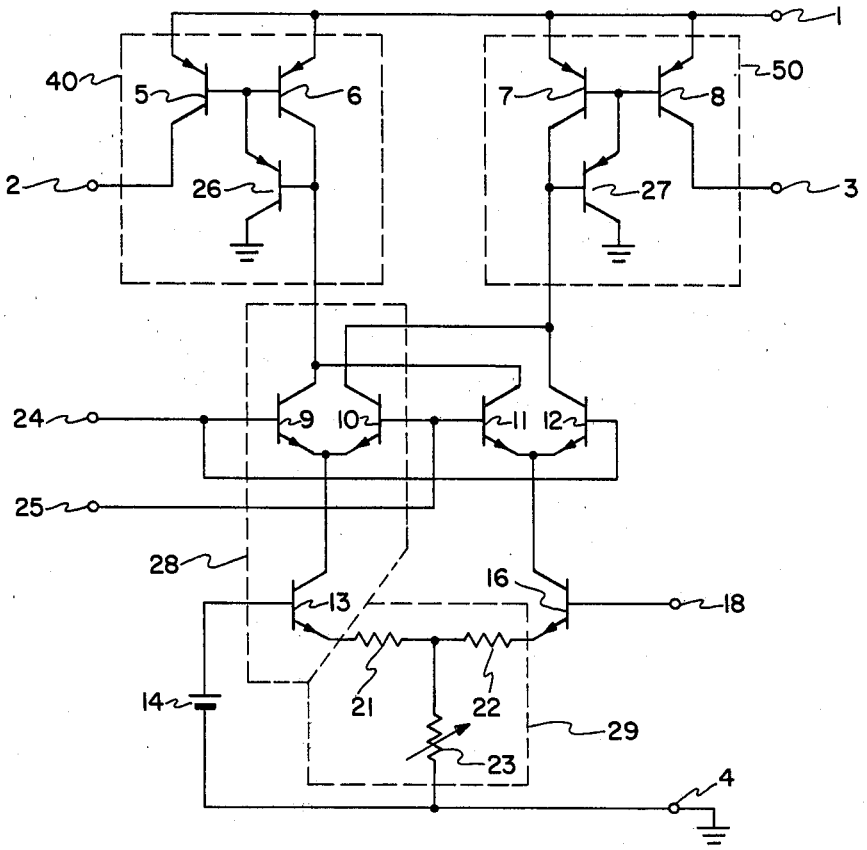
PRIOR ART FIG. 1
FIG. 1 is a circuit diagram showing a stereo signal demodulator of switching type using a differential amplifier according to the prior art.

With reference to the stereo signal demodulator according to the prior art, shown in FIG. 1, the composite signals are fed to an input terminal 18, which is connected to the base of a transistor 16. The emitter of transistor 16 is connected to a signal attenuator 29 consisting of a T-type resistor circuit network composed of resistors 21 and 22 and a variable resistor 23. The collector of the transistor 16 is connected to the common junction point of the emitters of switching transistors 11 and 12, for separating left and right channel signals from the composite signal. The bases of the switching transistors 12 and 11 are respectively supplied with the sub-carrier signal of 38 KHz, as a switching signal. The sub-carrier is received through switching signal input terminals 24 and 25, to separate the left and right signals from the composite signal. The phases of the switching signals applied to the switching signal input terminals 24 and 25 are opposite to each other. The collectors of the transistors 12 and 11 are respectively connected to right and left signal output circuits 50 and 40 which are current mirror circuits composing of transistors 7, 8 and 27 and transistors 5, 6 and 26, respectively. The outputs of the right and left signal output circuits 50 and 40 are respectively fed to right and left signal output terminals 3 and 2. To the left and right signal output circuits 40 and 50 are supplied a power supply voltage from a power supply terminal 1.

In order to cancel the left and right crosstalk components which are contained in the respective signals appearing at the right and left signal output terminals 3 and 2, there is provided a crosstalk cancellation switching circuit 28 composing of transistors 9, 10 and 13. These transistors 9 and 10 have their respective emitters connected in common. Their collectors are connected to the respective collectors of the transistors 11 and 12. Their bases are connected to the respective bases of the transistors 12 and 11. To the common junction point of the emitters of the transistors 9 and 10 is connected the collector of the transistor 13, which has its emitter connected with the signal attenuator 29. Its base is connected to a ground terminal 4 through a reference voltage source 14.

The operations of the demodulator according to the prior art will be described next. The composite signal is fed to the input terminal 18 and amplified by the transistor 16. The amplified signal is fed from the collector of the transistor 16 to the common junction between the emitters of the transistors 11 and 12. At this time, in response to the switching signal of 38 KHz fed to the switching signal input terminals 24 and 25, the transistors 11 and 12 are repeatedly switched between conductive and inconductive states, in an alternate manner.

Thus, the composite signal amplified by the transistor 16 are subjected to time division by the transistors 11 and 12. As a result, the right channel signal is fed to the right signal output circuit 50 in response to the conduction of the transistor 12, to derive a current output at the right signal output terminal 3, while the left channel signal is fed to the left signal output circuit 40 in response to the conduction of the transistor 11 to derive a current output at the left signal output terminal 2. The transistors 5 and 6 and the transistors 7 and 8, which constitute the current mirror circuits of the signal output circuits 40 and 50, are of PNP type. Therefore, their current gains are low and they might have characteristic deviations caused by their manufacturing condition. However, since the base current of those transistors are increased by the transistors 26 and 27, symmetry is maintained between the generated left and right output signals. Thus, the composite signals are demodulated into a stereophonic signal.

However, the right channel signal contains the crosstalk components of the left channel signal and vice versa, if they remain as they are. The crosstalk causes a deterioration in the separation between the right and left channel signals. In order to cancel those crosstalk components, therefore, there are additionally provided the crosstalk cancellation switching circuit 28 and the signal attenuator 29.

More specifically, the composite signal is applied to emitter of the transistor 16, through the input terminal 18 and is attenuated by a constant amount in the T-type resistor circuit network, which is the signal attenuator 29, composed of the resistors 21, 22 and 23. The attenuated signal is fed through the transistor 13 to the transistors 9 and 10. The crosstalk cancelling signals are superposed upon the right and left signal output circuits 50 and 40 after they are separated by the transistors 9 and 10, as they become conductive and nonconductive. Accordingly, by setting the resistances of the resistors 21, 22 and 23 for suitably attenuating the composite signal, the crosstalk component of the left channel which is contained in the right channel signal and the crosstalk component of the right channel which is contained in the left channel signal can be cancelled. Thus, the separation between the right and left channel signals is enhanced.

With the circuit construction thus far described, however, if the level of the composite signal and the stereo demodulation gain are raised, the separation between the right and left channel signals abruptly deteriorates when the power supply voltage fed to the power supply terminal 1 becomes too low.

Specifically, if the composite signal input voltage level and the demodulation gain are set at 1 vrms and −1 dB, respectively, a current of about 1 mA flows through the collectors of the transistors 6 and 7 and the same current flows through the loads or filter circuits which may be coupled to the signal output terminals 2 and 3. In this case, some potential loss occurs in the T-type resistor circuit network composed of the resistors 21, 22 and 23, so that the DC potential is raised at the junction point of the resistors 21 and 22. Since this DC potential is determined by the attenuation factor of the signal attenuator 29, this potential level is preset at about 0.4 V by selecting the resistances of the resistors 21, 22 and 23, for obtaining the attenuation factor by which the maximum separation is achieved.

Consequently, if an input voltage level of the composite signal is assumed at 1 vrms as described in the above, the composite signal has the maximum amplitude of 1.4 V. The base bias of the transistor 16 has to be higher than 2.6 V if some margin (0.1 V) is taken. Then, the composite signal having the maximum amplitude of 1.4 V swings the 2.6 V base bias of the transistor 16, as the center. Therefore, the base potentials of the transistors 9, 10, 11 and 12 have to be 4.8 V at the minimum if consideration is taken of the collector-emitter voltage of the transistor 16 under its saturated condition of the distortion characteristics of the demodulator. As a result, when the power supply voltage becomes lower than 6 V, the collector-emitter voltages of the transistors 9, 10, 11 and 12 are reduced, so that they are brought into their saturated conditions. Then, the transistors 9 and 10 of the crosstalk cancellation switching circuit 28 become inoperative. The crosstalk cancelling effect is decreased and the separation factor between the right and left channels abruptly deteriorates.

Figure 3:
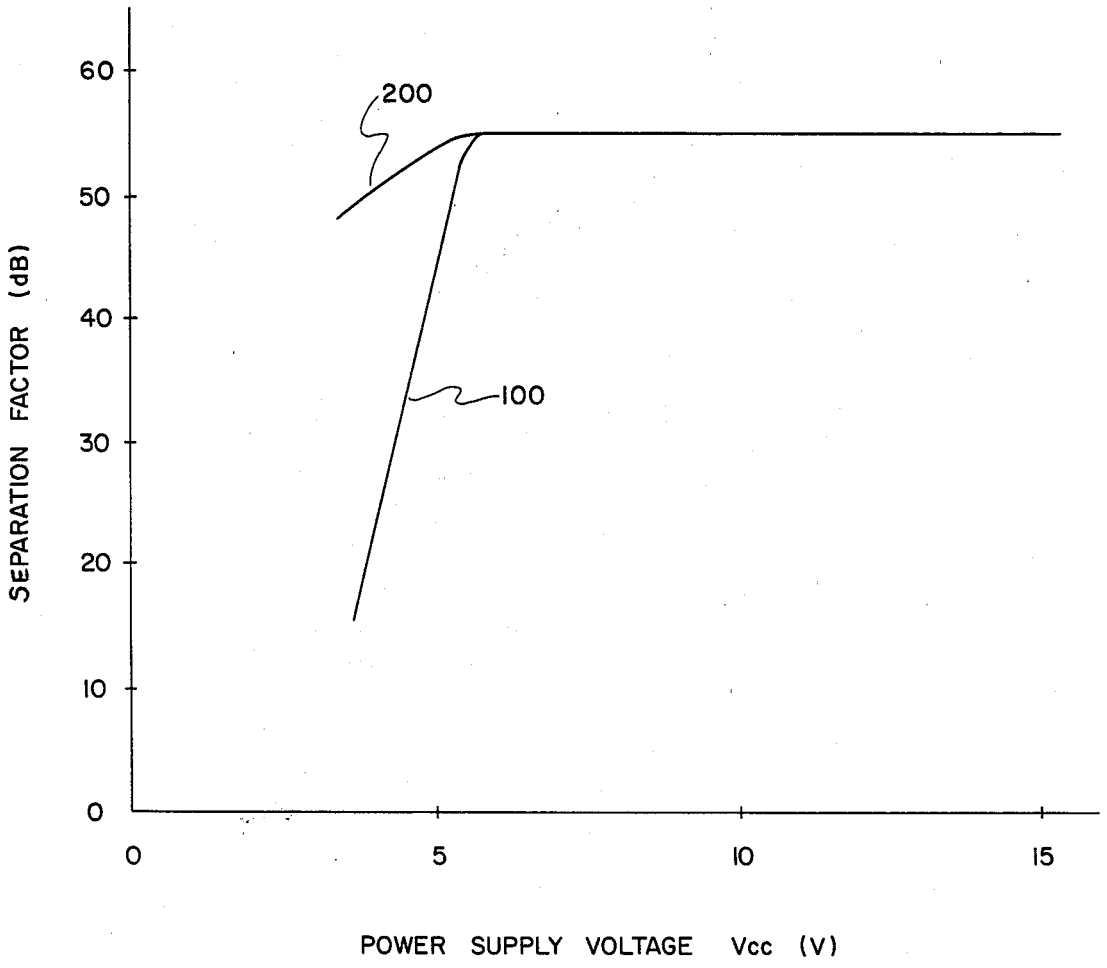
FIG. 3 is a graphical diagram showing the characteristic curves indicating the power supply voltage to separation factor of the stereo signal demodulator according to the prior art and according to the present invention.

This particular condition is illustrated in FIG. 3. In this Figure, a curve 100 indicates the characteristics of the power supply voltage $V_{CC}$ to the separation factor of the stereo signal demodulator, according to the prior art. As will be understood from the characteristic curve 100, the separation factor is 55 dB if the power supply voltage $V_{CC}$ is higher than 6 V, but separation abruptly deteriorates if the power supply voltage $V_{CC}$ is lower than 6 V. This is because the cancelling effect is decreased due to the reduction of the power supply voltage. Moreover, although the separation factor between the right and left channel does not deteriorate near the power supply voltage of 6 V, the collector-emitter voltages of the transistors 9, 10, 11 and 12 are low because they are about 0.5 V, so that the distortion factor deteriorates responsive to those transistors.

Thus, in the stereo signal demodulator of FIG. 1, according to the prior art, when the input level of the composite signal and the demodulation gain are designed at high levels, the separation abruptly deteriorates with the reduction in the power supply voltage. According to the conventional demodulator, it is impossible to raise the composite signal input level and the demodulation gain while improving the voltage reduction characteristics. In addition, the distortion factor, in the case of the operation at a low power supply voltage, deteriorates. In other words, in the conventional demodulator, it is extremely difficult to set the base bias potentials of the transistors 9, 10, 11, 12 and 16 to satisfy the aforementioned conditions while improving the voltage reduction characteristics.

Figure 2:
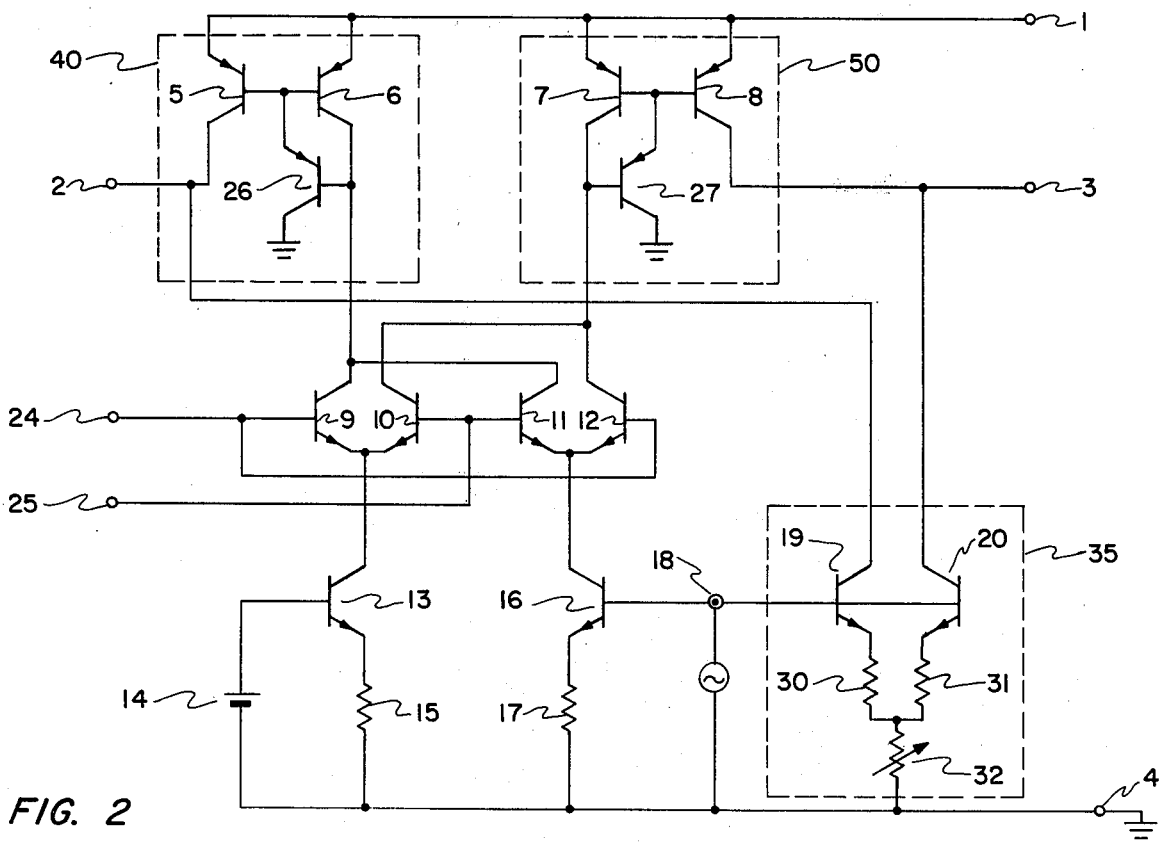
FIG. 2 is a circuit diagram showing a stereo signal demodulator according to a preferred embodiment of the present invention.

Next, a demodulator shown in FIG. 2, according to a preferred embodiment of the present invention, will be described. In this stereo signal demodulator, a crosstalk cancellation circuit 35 is connected in parallel with transistor 16 to the input terminal 18 to which the composite signal or the main and sub-channel signals of the composite signal are supplied. Therefore, the attenuator 29 (FIG. 1) which was connected to the transistors 16 and 13 in the prior art circuit can be eliminated. Instead, the emitters of the transistors 16 and 13 can be grounded through resistors 17 and 15, respectively.

The outputs of the crosstalk cancellation circuit 35 are taken from the collectors of transistors 19, 20 and are connected directly to the left channel signal output terminal 2 and to the right channel signal output terminal 3. By this configuration, the composite signal fed into the input terminal 18 is applied to both the base of the transistor 16 and the bases of transistors 19 and 20, which constitute the crosstalk cancellation circuit 35. Between the emitters of the transistors 19 and 20 is connected a T-type resistor circuit network consisting of resistors 30 and 31 and a variable resistor 32. The collectors of these transistors are connected to the left and right channel signal output terminals 2 and 3, respectively. According to this circuit construction, therefore, the transistors 9, 10 and 13, the resistor 15 and the constant voltage source 14 form a DC output current compensation circuit and are not parts of a crosstalk cancellation circuit, which is different from the conventional demodulator shown in FIG. 1.

The operations of the stereo signal demodulator, according to the preferred embodiment of the present invention, will be described next. The demodulated composite signal of the pilot tone system is applied to the input terminal 18, i.e., the composite signal is amplified by the common emitter amplifier of the transistor 16 and the resistor 17. The amplified signal is fed to the common junction point between the emitters of the transistors 11 and 12. These transistors 11 and 12 are repeatedly switched between conductivity and nonconductivity in response to the switching signals of 38 KHz produced from the pilot tone of 19 KHz and supplied to the switching signal input terminals 24 and 25. The amplified composite signal is subjected to time division as transistors 11 and 12 switch on and off. Thus, the composite signal is separated into the right and left channel signals.

More specifically, when the transistor 12 switches on, the right channel signal appears at the right channel signal output terminal 3 responsive to the output current through the output circuit 50, which is composed of the transistors 7, 8 and 27. On the other hand, when the transistor 11 switches on, the left channel signal appears at the left channel signal output terminal 2 responsive to the output current through the output circuit 40, which is composed of the transistors 5, 6 and 26. These left and right channel signals appear at the two channel signal output terminals 2 and 3, respectively, and contain the corsstalk components of the opposite channels, as described hereinbefore.

However, the two channel signal output terminals 2 and 3 also receive the composite signal from the crosstalk cancellation circuit 35, with such a quantity that it can cancel the aforementioned crosstalk components. More specifically, the composite signal fed to the input terminal 18 is applied to the respective bases of the transistors 19 and 20. The composite signal fed to the transistor 16 is attenuated to perform a normal stereo switching action. The signal applied to the transistors 19 and 20 is attenuated by the resistors 30, 31 and 32 connected between the emitters of those transistors in order to generate the signals for the crosstalk cancellation. This attenuated composite signal for the crosstalk cancellation is fed to the left channel signal output terminal 2 and the right channel signal output terminal 3, through the respective collectors of the transistors 19 and 20. Therefore, by suitably setting the resistance values of the resistors 30, 31, 32 and 17, the crosstalk components of the opposite channels contained in the left and right channel signals can be cancelled.

In this demodulator, the resistance values of the resistors 17, 30 and 31 are preferably 1.2 kohms, and 5.1 kohms, respectively. Therefore, it is sufficient that the resistance value of the variable resistor 32 is adjusted to maximize the separation factor. The attenuation quantity for maximizing the separation factor, (i.e., the optimum ratio of the base to collector signal level of the transistor 19 or 20) is $k_1=0.1817$, if that optimum ratio is assumed to $k_1$. The resistance value of the resistor 32 for obtaining this value of $k_1$ is at about 752 ohms, and then the maximum separation factor can be obtained. Moreover, the range of k which is necessary for attaining the separation factor higher than 50 dB is from 0.1768 to 0.1868. If, in this case, the resistance values of the resistors 17, 30 and 31 are left as they are, it is sufficient for the resistance value of the resistor 32 to be adjusted over the range from 653 ohms to 876 ohms. Thus, the separation factor of the right and left channels is increased.

Incidentally, other combinations of the resistors 17, 30 and 31, can be used. It is sufficient that the resistance value of the resistor 32 is adjusted in accordance with the selected combination. Needless to say, when the separation factor is higher than 40 dB, $k=0.1654$ to 0.1986 holds, so that the range of the resistance value of the resistor 32 can be widened.

It is not necessary to connect the T-type resistor circuit network composed of the resistors 30, 31 and 32 between the emitters of the transistors 19 and 20. The respective emitters may be alternatively grounded through a single resistor having the resistance value adjusted to cancel the crosstalk components. In this modification, two terminals are required for the respective emitter resistors, so that the embodiment mentioned hereinbefore is more advantageous.

When the composite signal input voltage level and the demodulation gain are respectively assumed at 1 vrms and −1 dB as described in the above, and since the emitter of the transistor 16 is connected to the ground terminal 4 through the resistor 17, the base bias of the transistor 16 may be 2.2 V with a slight margin (0.1 V). Therefore, the voltage level of the reference voltage source 14 may be designed at 2.2 V. Then, the composite signal having the maximum amplitude of 1.4 V swings the base voltage of the transistor 16 from the base bias voltage of 2.2 V. Moreover, if consideration is taken of the collector-emitter voltage of the transistor 16, under its saturated condition and the distortion characteristics of the demodulator, the base potential of the transistors 9, 10, 11 and 12 may be set at 4.4 V.

On the other hand, the crosstalk components appearing at the left and right channel signal output terminals 2 and 3 are cancelled because the output of the crosstalk cancel circuit 35 is respectively fed directly to those terminals 2 and 3. Accordingly, when the power supply voltage fed to the power supply terminal 1 becomes lower than 6 V, the crosstalk of the switching circuit composed of the transistors 11 and 12 is increased. However, the transistors 19 and 20 of the crosstalk cancellation circuit 35 are saturated at a low power supply voltage, as compared to the voltage at which the transistor 11 and 12 are saturated. The crosstalk cancelling operation is maintained even with the reduction in the power supply voltage, at which the transistors 19 and 20 of the crosstalk cancellation circuit 35 are saturated. Consequently, even if the main voltage becomes as low as about 4 V, the separation factor between right and left channels does not abruptly deteriorate. This is because the switching circuit is not connected in series with the crosstalk cancellation circuit 35.

This condition is illustrated in FIG. 3 by a curve 200. Specifically, the separation factor of 55 dB is obtained if the power supply voltage is higher than 6 V. The separation factor of 50 dB can be obtained even when the power supply voltage becomes as low as 4 V.

Moreover, as described hereinbefore, since the base bias potentials of the transistors 16, 11 and 12 can be designed at low levels, their collector-emitter voltages can be increased to the same power supply voltage that is used in the prior art. For instance, for the power supply voltage of 6V, the collector-emitter voltages of the transistors 11 and 12 have a value of 0.9 V, and of the transistor 16 has a value of 2.2 V, so that the distortion factor can be further decreased.

According to this preferred embodiment, the crosstalk cancellation circuit 35 is connected to the input terminal 18 in parallel with the transistor 16. The transistor 16 operates as a common emitter amplifier. The signal attenuator 29 (FIG. 1) is not connected to the emitter of the trasistor 16 (FIG. 2) as in the prior art. By these constructions, the base potentials of the transistor 16 and the transistor 11 and 12 can be easily designed, so that the degree of freedom for the circuit is increased very much. On the contrary, in the conventional demodulator, the base bias of the transistor 16 has to be determined in accordance with both the composite signal input voltage level and the attenuation constant of the signal attenuator 29, so that the degree of freedom for the circuit design is considerably decreased. In addition, since a transistor 16 is used as the common emitter amplifier according to this embodiment, there is such advantage that the input dynamic range can be increased.

According to the stereo signal demodulator of this embodiment, even when the composite signal input level is assumed at 1 vrms and the demodulation gain is as high as −1 dB, the separation factor between the right and left channels is sufficiently high at the power supply voltage of about 4 V. A much lower distortion is achieved for the same power supply voltage. Moreover, the base potentials of the transistor 16 and the switching transistors 11 and 12 can be easily designed. The input dynamic range can also be widened.

As described hereinbefore, according to the present invention, even when the composite signal input level is high and the stereo demodulation gain is also high, it is possible to provide a stereo signal modulator which can have a high separation factor, excellent voltage reducing characteristics, and a reduced distortion factor.

It should be noted here that the present invention should not be limited to the aforementioned embodiment. It can be modified in various forms without departing from the scope and spirit of the present invention. For example, although the resistor 32 is a variable type, in the present embodiment, it may be fixed in accordance with the composite signal attenuation because the attenuation for cancelling the crosstalk components can be easily determined. In addition, the two output circuits 40 and 50 are constructed by current mirror circuits in order to generate the current outputs, but they may have other circuit constructions, such as resistor loads.

Moreover, the present invention can naturally be formed into an integrated circuit, constructed on a single semiconductor substrate. It is suitable for such integration construction because it contains no capacitor element. Moreover the composite signal demodulating means may be not only the differential amplifiers but also diode switching circuits. Furthermore, the transistors 9, 10 and 13, the resistor 15 and the reference voltage source 14 constitute a DC current applying circuit which compensates for the change in the output DC current due to the switching of the transistors 11 and 12. Consequently, if the left and right channel output terminals 2 and 3 are coupled through coupling capacitors to filter circuits or the like of the next stage, the DC current supplying circuit of the transistors 9, 10 and 13, etc. can be eliminated. This is because, even if the aforementioned bias circuit is eliminated, the output signal are transfered to the next stage despite any change in output.

What is claimed is:

1. A stereo signal demodulator comprising an input terminal supplied with a stereo composite signal, a first transistor having a base coupled to said input terminal and an emitter coupled to a reference potential by way of a resistor, switching citrcuit means coupled to receive a collector output of said first transistor and alternately coupled to generate an output signal at its first and second output ends in response to first and second switching signals, said first switching signal having a phase opposite to the phase of said second switching signal, left and right channel output terminals coupled to said first and second output ends of said switching circuit means, respectively, the output signal generated at said first output end of said switching circuit means comprising essentially a left channel signal and a right channel crosstalk signal, the output signal generated at said second output end of said switching circuit means comprising essentially a right channel signal and a left channel crosstalk signal, crosstalk cancellation circuit means having second and third transistors each having a base coupled to said input terminal and a resistor circuit means coupled between emitters of said second and third transistors, an attenuated stereo composite signal being generated at collectors of said second and third transistors, respectively, and means for supplying said attenuated stereo composite signal to said left and right channel output terminals in order to obtain a high channel separation factor between left and right channels.

2. The stereo signal demodulator claimed in claim 1, wherein said resistor circuit means has three resistors forming a T-type resistor circuit network, said T-type resistor circuit network having first and second ends connected respectively to the emitters of said second and third transistors and a third end connected to said reference potential.

3. The stereo demodulator claimed in claim 2, wherein said switching circuit means has fourth and fifth transistors, said fourth transistor having a base supplied with said first switching signal, an emitter coupled to the collector of said first transistor and a collector coupled to said first output end, said fifth transistor having a base supplied with said second switching signal, an emitter coupled to the collector of said first transistor and a collector coupled to said second output end.

4. A stereo signal demodulator comprising an input terminal supplied with a stereo composite signal, a first transistor having a base coupled to said input terminal and an emitter coupled to a reference potential through a first resistor, constant voltage source means for generating a constant voltage at its output end, a second transistor having a base coupled to said output end of said constant voltage source means and an emitter coupled to said reference potential through a second resistor, switching circuit means for receiving a collector output of said first transistor and for generating a first signal comprising a left channel signal and a right channel crosstalk component at a first output end of said switching circuit means and a second output signal comprising a right channel signal and a left channel crosstalk component at a second output end of said switching circuit means, said left and right channel signals being generated in response to a sub-carrier wave signal, a D.C. output current compensation circuit means for receiving a D.C. current flowing through a collector of said second transistor and for alternately generating a D.C. current at said first and second output ends in response to said sub-carrier wave signal, the first output end of said switching circuit means and the second output end of said D.C. output voltage compensation circuit means being coupled to each other, the second output ends of said switching circuit means and the first output end of said D.C. output voltage compensation circuit means being coupled to each other, the D.C. current at the first output end of said D.C. output voltage compensation circuit means being generated when said first signal is generated at the first output end of said switching circuit means, the D.C. current at the second output end of said D.C. output voltage compensation circuit means being generated when said second signal is generated at the second output end of said switching circuit means, crosstalk cancellation circuit means having third and fourth transistors each having a base connected to said input terminal and a resistor attenuation circuit connected between emitters of said third and fourth transistors, for generating an attenuated composite stereo signal at collectors of said third and fourth transistors, left and right channel output terminals coupled respectively to the first and second output ends of said switching circuit, and means for connecting collectors of said third and fourth transistors to said left and right channel output terminals, respectively, in order to supply the attenuated composite signals to said left and right channel output terminals.

5. The stereo signal demodulator claimed in claim 4, wherein said resistor attenuation circuit comprises third, fourth and fifth resistors, said third and fourth resistors being connected in series between the emitters of said third and fourth transistors, said fifth resistor being connected between a connection point of said third and fourth resistors and said reference potential.

6. The stereo signal demodulator claimed in claim 5, wherein said switching circuit comprises fifth and sixth transistors, and said D.C. output current compensation circuit means comprises seventh and eighth transistors, said fifth transistor having an emitter connected to the collector of said first transistor and a collector connected to the first output end of said switching circuit means, said sixth transistor having an emitter connected to the collector of said first transistor and a collector connected to the second output end of said switching circuit means, said seventh transistor having a base connected to a base of said sixth transistor, an emitter connected to the collector of said second transistor and a collector connected to the second output end of said D.C. output voltage compensation circuit, said eighth transistor having a base connected to a base of said fifth transistor, an emitter connected to the collector of said second transistor and a collector connected to the first output end of said D.C. output voltage compensation circuit means, said fifth and sixth transistors being in a conductive state and a nonconductive state alternately in response to said sub-carrier wave signal, said seventh and eighth transistors operating alternately in a conductive state and a nonconductive state in response to said sub-carrier wave signal.

7. The stereo signal demodulator claimed in claim 6, further comprising first and second output circuit means of a current mirror type, said first output circuit means supplying a signal corresponding to said first signal to said left channel output terminal, said second output circuit supplying a signal corresponding to said second signal to said right channel output terminal.

8. A stereo signal demodulator comprising an input terminal supplied with a stereo composite signal, a power supply terminal, a ground terminal, a first transistor having a base coupled to said input terminal and an emitter coupled to said ground terminal by way of a first resistor, reference voltage source means for generating a reference voltage at its output, second transistor means having a base coupled to the output of said reference voltage source and an emitter coupled to said ground terminal by way of a second resistor, first and second switching signal input terminals supplied with a sub-carrier wave signal, the sub-carrier wave signal supplied to said first switching signal input terminal having a phase which is opposite to the phase of the sub-carrier wave signal supplied to said second switching signal input terminal, switching circuit means having third and fourth transistors forming a first differential amplifier, said third transistor having a base coupled to said first switching signal input terminal and an emitter coupled to a collector of said first transistor, said fourth transistor having a base coupled to said second switching signal input terminal and an emitter coupled to the collector of said first transistor, D.C. output current compensation circuit means having fifth and sixth transistors forming a second differential amplifier, said fifth transistor having a base coupled to said first switching signal input terminal and an emitter coupled to a collector of said second transistor, said sixth transistors having a base coupled to said second switching signal input terminal and an emitter coupled to the collector of said second transistor, collectors of said third and sixth transistors being coupled to each other, collectors of said fourth and fifth transistors being coupled to each other, first current mirror output circuit means coupled between the collector of said third transistor and said power supply terminal, second current mirror output circuit means coupled between the collector of said fourth transistor and said power supply terminal, a left channel output terminal coupled to said first current mirror output circuit means, a right channel output terminal coupled to said second current mirror output circuit means, crosstalk cancellation circuit means having seventh and eighth transistors and a resistors circuit, said seventh and eighth transistors each having a base coupled to said input terminal, said resistor circuit having a first end coupled to an emitter of said seventh transistor, a second end coupled to an emitter of said eighth transistor and a third end coupled to said ground terminal, and means for coupling collectors of said seventh and eighth transistors of said left and right channel output terminals, respectively, said switching circuit means receiving the stereo composite signal through the collector of said first transistor and generating a first signal comprising a left channel signal and a right channel crosstalk signal at the collector of said third transistor and a second signal comprising a right channel signal and a left channel crosstalk signal at the collector of said fourth transistor, said switching circuit means operating in response to said sub-carrier wave signal, said D.C. output current compensation circuit means receiving a D.C. current through the collector of said second transistor and generating a first D.C. current at the collector of said fifth transistor and a second D.C. current at the collector of said sixth transistor in response to said sub-carrier wave signal, said crosstalk cancellation circuit means attenuating said stereo composite signal and generating an attenuated stereo composite signal at collectors of said seventh and eighth transistors, whereby a wide input dynamic range, low distortion in left and right channel output signals and a high degree of channel separation are obtained at a low power supply voltage, and further D.C. voltages are maintained constant at left and right channel output terminals.

9. The stereo signal demodulation circuit claimed in claim 8, wherein said resistor circuit comprises third, fourth and fifth resistors, said third and fourth resistors being coupled in series between the first and second ends of said resistor circuit, said fifth resistors being coupled between a common point on said third and fourth resistors and the third end of said resistor circuit.

10. The stereo signal demodulation circuit claimed n claim 9, wherein said first current mirror output circuit means comprises ninth and tenth transistors, and said second current mirror output circuit means comprises eleventh and twelfth transistors, said ninth transistor having an emitter coupled to said power supply terminal and a collector coupled to the collector of said third transistor, said tenth transistor having a base coupled to a base of said ninth transistor, an emitter coupled to said power supply terminal and a collector coupled to said left channel output terminal, said eleventh transistor having an emitter coupled to said power supply terminal and a collector coupled to the collector of said fourth transistor, said twelfth transistor having a base coupled to a base of said eleventh transistor, an emitter coupled to said power supply terminal and a collector coupled to said right channel output terminal, the base and the collector of said ninth transistor being coupled together, the base and the collector of said eleventh transistor being coupled together.

11. The stereo signal demodulation circuit claimed in claim 10, wherein said first current mirror output circuit means further comprises a thirteenth transistor, and said second current mirror output circuit means further comprises a fourteenth transistor, said thirteenth transistor having a collector coupled to said ground terminal and a base and an emitter coupled respectively to the collector and the base of said ninth transistor, said fourteenth transistor having a collector coupled to said ground terminal and a base and an emitter coupled respectively to the collector and the base of said eleventh transistor.

* * * * *